United States Patent [19]

Pym

[11] Patent Number: 4,625,880

[45] Date of Patent: Dec. 2, 1986

[54] CONTAINERS

[76] Inventor: Kenneth B. Pym, 1 Conway Avenue, Clitheroe, Lancashire, England

[21] Appl. No.: 751,381

[22] Filed: Jul. 3, 1985

[30] Foreign Application Priority Data

Dec. 12, 1984 [GB] United Kingdom ..... 8431372

[51] Int. Cl.[4] ..... B65D 7/24

[52] U.S. Cl. ..... 220/4 F; 220/1.5; 220/80

[58] Field of Search ..... 220/4 F, 1.5, 72.1, 220/76, 80, 84

[56] References Cited

U.S. PATENT DOCUMENTS

| | | | |
|---|---|---|---|
| 2,924,638 | 2/1960 | Feketics | 220/80 X |
| 3,401,814 | 9/1968 | Chiswell et al. | 220/1.5 X |
| 3,589,547 | 6/1971 | Hambleton | 220/4 F X |
| 3,589,548 | 6/1971 | Weiss | 220/80 X |
| 3,968,895 | 7/1976 | Barnes, Jr. et al. | 220/80 X |
| 4,325,488 | 4/1982 | Ketner | 220/80 X |

*Primary Examiner*—Steven M. Pollard

*Attorney, Agent, or Firm*—Fidelman, Wolffe & Waldron

[57] ABSTRACT

A strike down container consisting essentially of a base member, a top member, two pairs of side members, a first end member, and a second end member which may comprise a door means. The side members are joined in their pairs by means of a coupling member suitably of an H-shape cross-section which extends along adjacent long sides of the side members. The end and side members extending from the base member to the top member and the end side members and the top member are so dimensioned that they all stack on top of the base member within the boundary of the short and long sides of the rectangular base. Releasable fasteners are provided between the base member, side members, and end members and top member. The division of the side members into pairs with the reinforcement of the coupling members ensures that a large strike down container can be provided and also enables thin sheet material to be used for the side members so that the struck down container takes up very little space and is lightweight. In a preferred embodiment, seven struck down containers stacked on top of each other take up the space of one erected strike down container.

11 Claims, 10 Drawing Figures

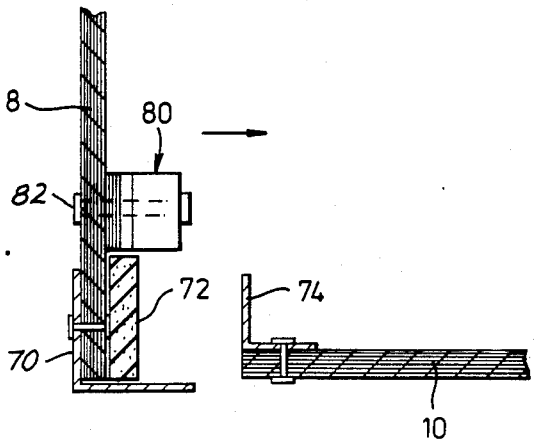
Fig. 6.
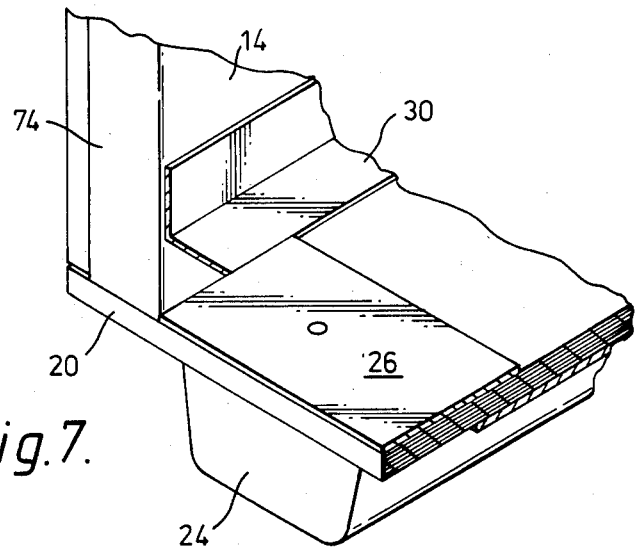
Fig. 7.
Fig. 8.
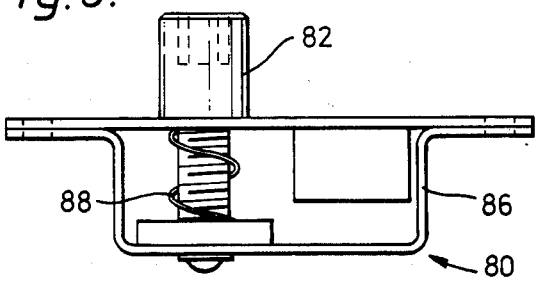
Fig. 9.
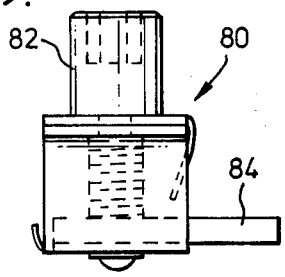

CONTAINERS

The present invention relates to a strike down transport or shipping container.

BACKGROUND OF THE INVENTION

Containers of a relatively small size for packaging personal effects and so on are known which are designed to be transported several at a time in a larger standard 40 foot (12 meter) container. These small containers are designed to be collapsible for storage or transport.

Such a container is shown in U.S. Pat. No. 3,809,278. Although this container is easily collapsible and robust, it has the disadvantage of being bulky when collapsed and is also heavy. Such bulk and weight is 'dead'.

Other collapsible or strike down containers are known from U.S. Pat. No. 3,877,602, G.B. Pat. Nos. 649,636 and 666,117, but these containers also suffer from similar disadvantages of excess 'dead' bulk and weight.

SUMMARY OF THE INVENTION

Accordingly, it is an object of the present invention to reduce the 'dead' bulk and weight of collapsible containers and provide a small container which is sufficiently strong for further containerisation in a larger container, which can be easily struck down and stored in the minimum amount of space.

A container according to the present invention comprises a rectangular base having a width shorter than the length and a top member of similar width and length, two pairs of side members, each pair fastened when erected to each long side of the base and the top member by fastening means allowing easy detachment therefrom, two end members, each end member fastened when erected to a short side of the base and top member by fastening means allowing easy detachment therefrom, each side member and each end member having a width not greater than the width of the base and a length not greater than the length of the base, a coupling means extending along substantially the whole length of and between each pair of side members to join the pairs of side members together in a side-by-side co-planar arrangement and fastening means allowing easy detachment of the side members of each pair from each other, whereby when struck down the side members, end members and the top member may be stacked flat on top of the base within and not extending outside the dimensions of the short and long sides of the base.

The dimensions of the base are preferably about 2.2 meters on the long side by about 1.2 meters on the short side. The side and end members are preferably about 2.2 meters in length so that when erected the container is about 2.2 meters high. These dimensions ensure the best use of cargo space inside a standard 12 meter (40 foot) shipping container.

When struck down with the side members, end members and top member stacked flat on the base, the total height of the struck down container of the invention is only about 305 mm so that about seven struck down containers can be shipped in the space of a single erected strike down container.

A suitable coupling means for joining a pair of side members together in a side-by-side co-planar arrangement is a member having an H-shaped cross-section and having two pairs of laterally spaced arms extending in opposite linear directions from a central portion. Each pair of the arms supports a long side edge of a said side member formed suitably of a sheet of material such as plywood.

The base is preferably provided with skids enabling four-way fork lift access. In the preferred embodiment three formed plates for this are provided, each plate having three downwardly projecting skid portions.

The side and end members are preferably provided with latches for interconnection with the top member and base member and between each other, 13 latches being provided for each long side and six latches being provided for an end member which forms an access door. The side and end members are preferably sealed to the top and base members by means of resilient seals clamped into sealing engagement between the members by means of the latches.

An embodiment of the invention will now be described with reference to the accompanying drawings in which:

FIG. 6 is a sectional view taken along line III—III of FIG. 1 showing a similar view to FIG. 3 with the door open;

FIG. 7 is an isometric sectional view taken along line VII—VII of FIG. 1 showing the side to base junction at one corner of the base;

FIG. 8 is a side, elevational view of a door latch shown in FIGS. 3 and 6;

FIG. 9 is a top plan view of the latch shown in FIG. 8; and

Figure 1:
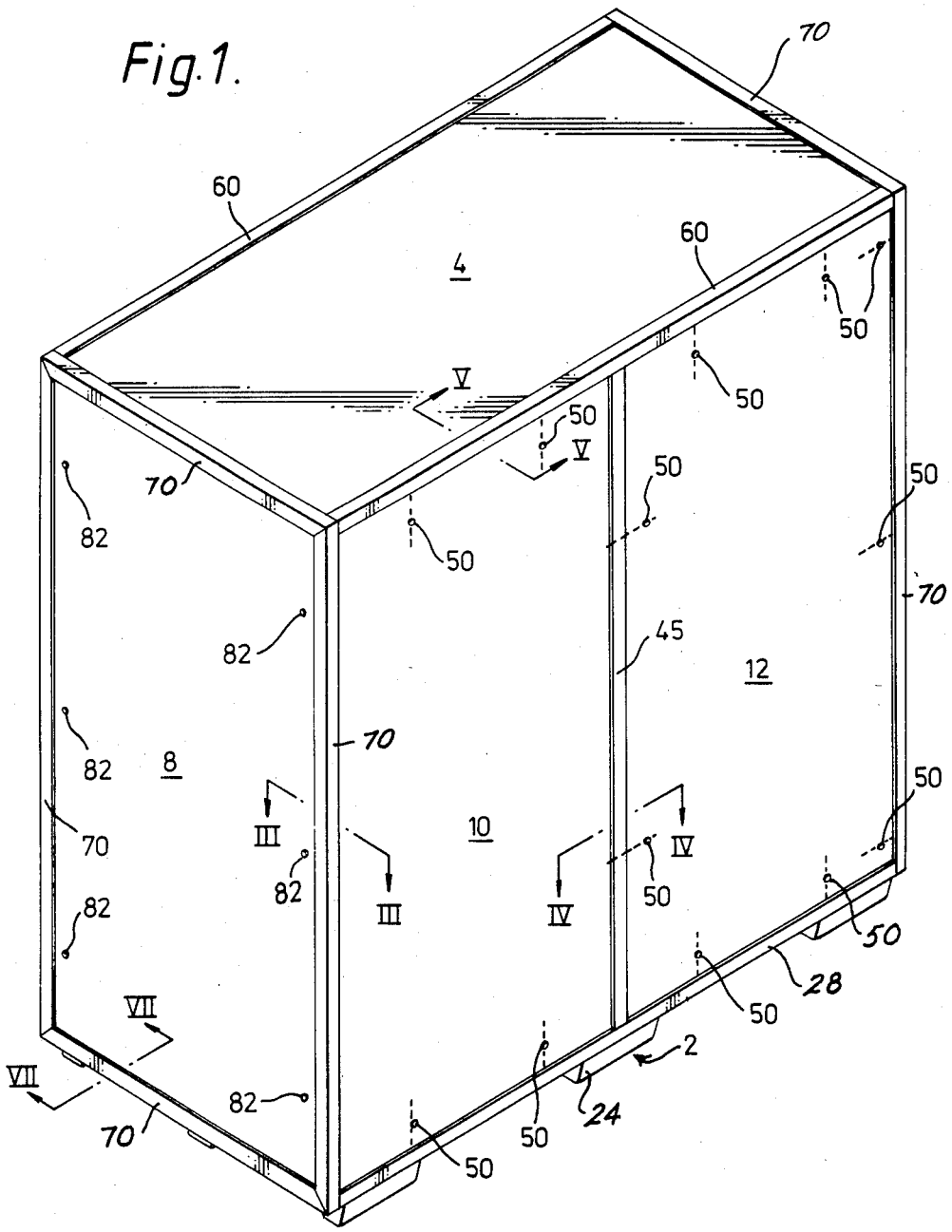
FIG. 1 is an isometric view of a container according to the invention.
Figure 2:
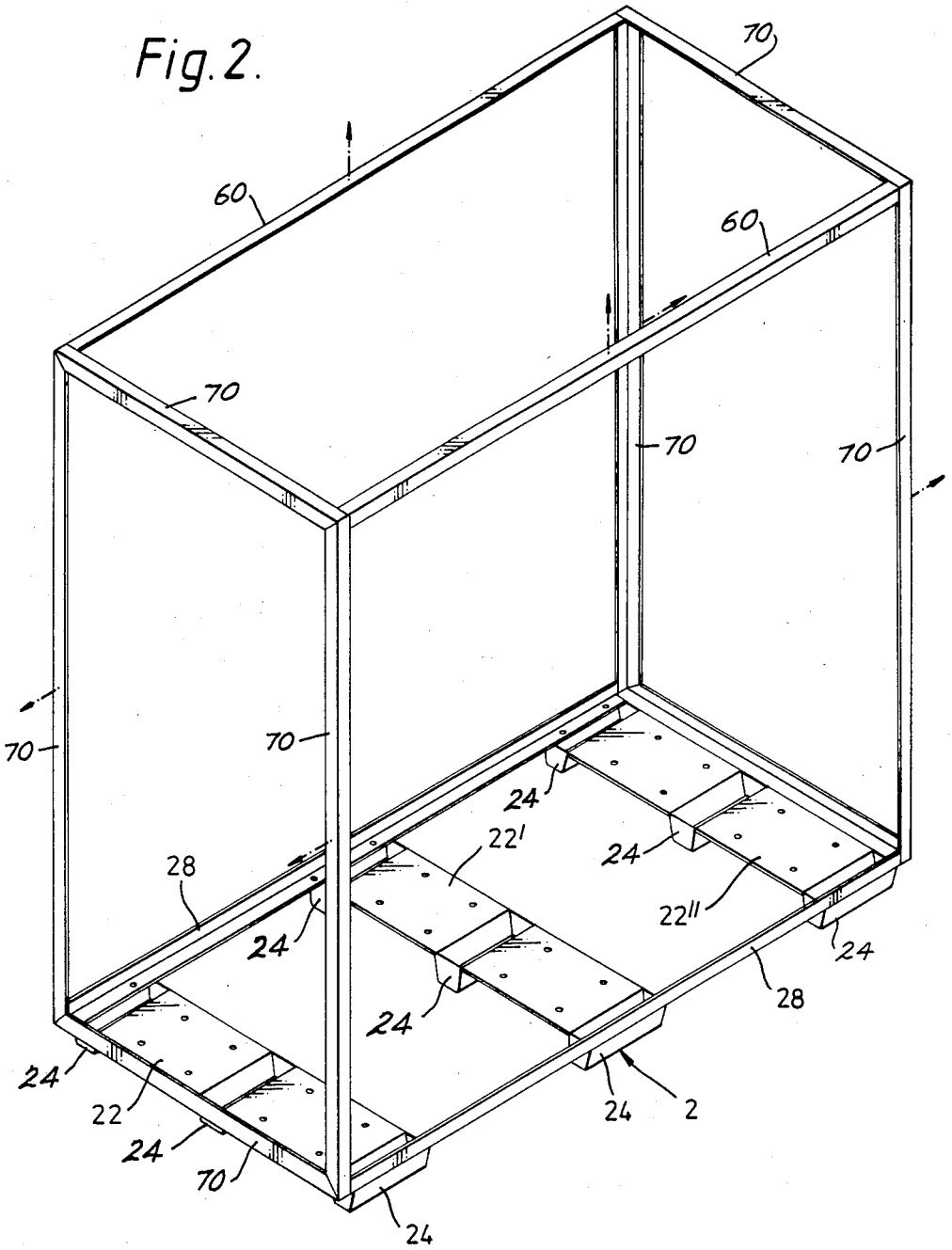
FIG. 2 is an isometric view similar to FIG. 1 showing the container in a skeletal form to show the base.

The container as shown in the drawings is essentially formed from a base member 2, a top member 4, a first end member 6, a second end member 8 which acts as a door, and two pairs of side members 10, 12 and 14, 16 (the last pair of which are not visible in FIG. 1). Members 4, 6, 8, 10, 12, 14 and 16 are designed to strike down onto base 2. The dimensions of the container when erected are 1.195 m wide, 2.185 m long, and 2.175 m high (that is to say about 1.2 m×2.2 m×2.2 m). As side members 10 to 16 are of similar dimensions it will be understood the struck down members all can be fitted within the dimensions of the base member 2. In the struck down and stacked condition on the base they are 305 mm high including the base.

The base member 2 is formed from a sheet 20 of marine quality hardwood plywood, 12.5 m thick to which is secured three metal skid members 22, 22' and 22'' each formed with three feet 24. The spanning and height of the feet are such that the container can be lifted by a fork lift entering at any side of the container. The skid members are secured by means of rivets and stepping plates 26. At the long sides of the base are support members comprising an outer and an inner metal angle support strip 28, 30 spaced apart in the same way as the outer and inner metal angle support strips 60, 62 on the top member 4 (see FIG. 5) and riveted to the ply sheet 20. In the gap between the strips 28, 30 is a rubber weather seal similarly placed to that shown at 32 in FIG. 5. Secured to the inner side of inner strip 30 along each side are four latch brackets 34 each of which has a pin 44 (see FIG. 5) to receive a latch arm 38 which is pivotally mounted on a side member 10–16 on an eccentric in the same way as will be described below relative to FIG. 10. Engagement of the latch arm 38 with pin 44 and rotation of the eccentric pulls a side member 10–16 in between support strips 28 and 30 or 60 and 62 into respective sealing engagement with the bottom member 20 or top member 4 with the seal 32 therein between.

Figure 4:
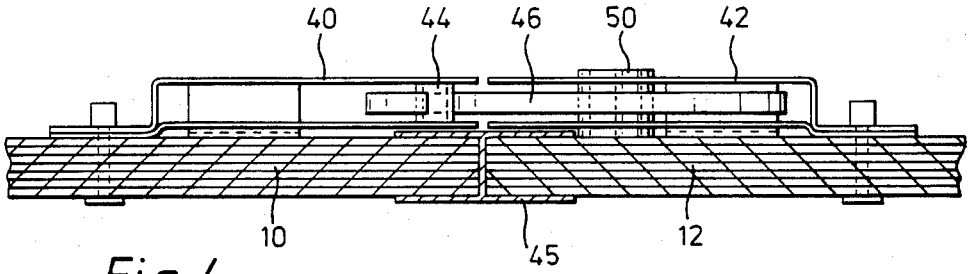
FIG. 4 is a sectional view taken along line IV—IV of FIG. 1 showing the latching together of two side members.
Figure 5:
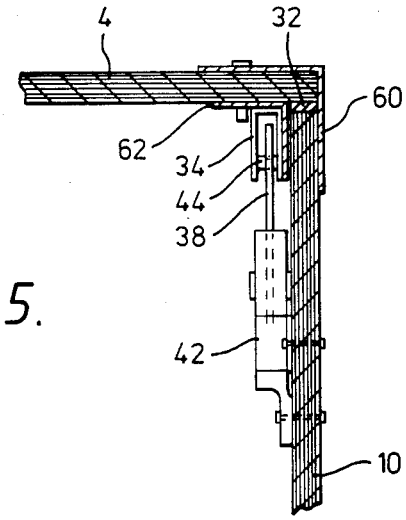
FIG. 5 is a sectional view taken along line V—V of FIG. 1 showing the latching together of a side member to the top member.
Figure 10:
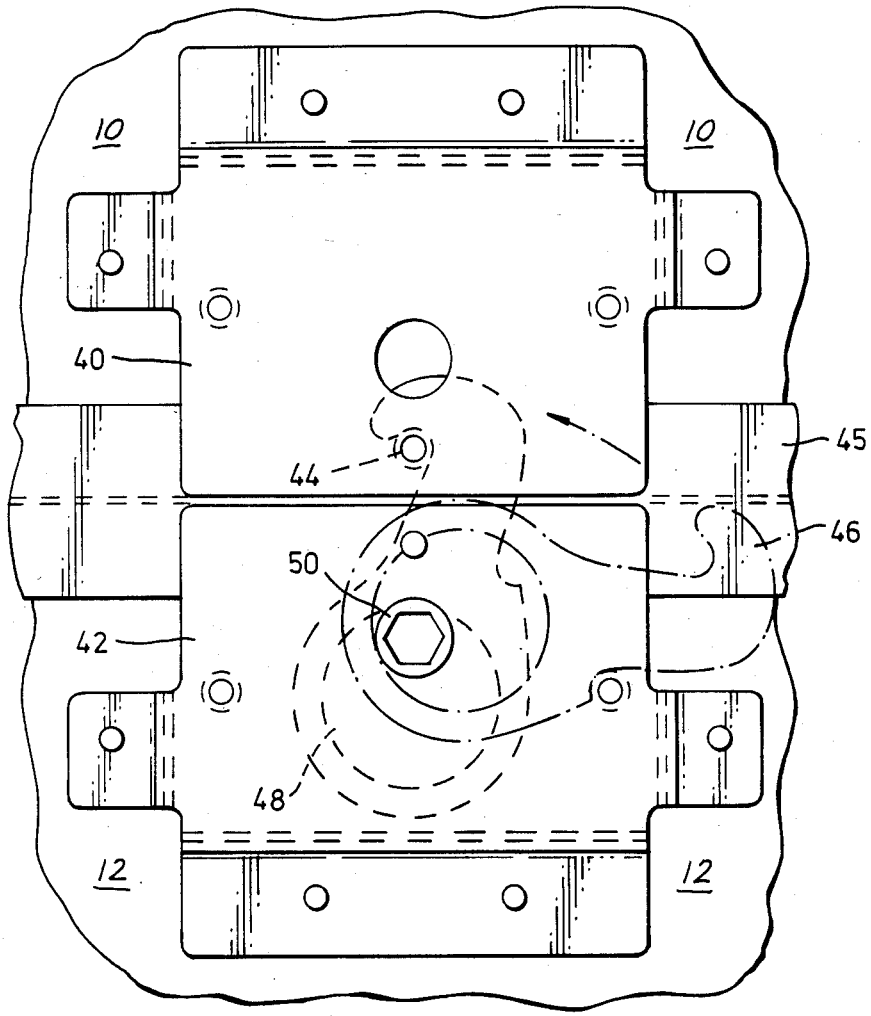
FIG. 10 is a side, elevational view of the latch shown in FIG. 4 for latching two side members together, taken from inside the container.

The side members 10, 12, 14 and 16 are all of a similar size, and each side member is formed of a single marine quality hardwood plywood sheet 9.5 mm thick. To form a complete side, a pair of side members 10 and 12 or 14 and 16 is erected and joined together on the base as described above in a side-by-side and co-planar arrangement by a coupling means having an H-shaped cross-section (see FIG. 4) in between and running from the bottom to the top of the container. Two latches comprising a pin bracket 40 and an arm bracket 42 are provided on each side member as shown in FIGS. 4 and 10. The pin bracket 40 has a pin 44 which receives an arm 46 mounted on an eccentric 48 which is in turn mounted on an operating 50. Rotation of operating pin 50 causes the arm 46 to turn until it engages with pin 44 and pulls pin bracket 40 to bracket 42 to firmly hold the side members in the 'H' strip 45. The operation is the same as the side 10 top 4 latching operation shown in FIG. 5. The top member 4 is formed from a single 12.5 mm thick plywood sheet and is latched to the side members by four latches on each side as shown in FIG. 5. The top member has a pair of angle strips 60 and 62 on each side similar to the base and running along the long sides.

Figure 3:
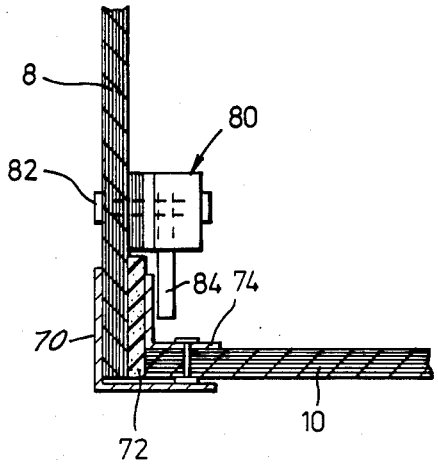
FIG. 3 is a sectional view taken along line III—III of FIG. 1 showing an end door fixing latch with the door closed.

Members 6 and 8 each formed of a single 9.5 mm thick plywood sheet with an outer angle support strip 70 all around the outside and having a rubber seal strip 72 on the inside fits against the top, sides and base against an inner angle support strip 74 on the sides and against the ends of the sheets of the top and base. Six latches 80 (see FIG. 3) of a different design to the latch shown in FIG. 10 are designed to pull one end 8 forming a door onto the adjacent sealing surface. Latch 80 (see FIGS. 8, 9) has a central operating pin 82 threaded into an arm 84 both mounted in a bracket 86. On turning the pin 82, the arm 84 first rotates with the pin 82 being held thereto by spring 88 until it hits the side of bracket 86 and engages inside support strip 74. The arm 84 then screws down the pin 82 pulling the end members 6 or 8 with it onto the support strip 74. Further screwing of pin 82 ensures a firm clamping onto support 74 with sealing by means of seal 72. The other end 6 is latched with latches as shown in FIG. 10. Striking down of the container is in the reverse order.

A total of thirteen latches of the type shown in FIG. 10 are fixed to each side in the general positions 50 as shown in FIG. 1 (four each on members 10 and 14 and nine each on members 12 and 16) whilst six latches as shown in FIG. 8 are fixed to the door 8 in the general positions 82 as shown in FIG. 1.

Watertightness is maintained without caulking. The sealant strip material is of suitable resilient material such as rubber or neoprene at all points of contact between component sections. The sealant strip is compressed with sealing tightness by the operation of the latches. All the latches are operable by means of Allen-type keys. Preferably provision is made on the door for customs or security seals.

I claim:

1. A strike down container having a width shorter than its length and consisting essentially of a base member, a top member, two opposing vertical end members, and two pairs of vertical side members, each pair of vertical side members comprising two sheets of material in a side-by-side, co-planar arrangement, said pair of vertical side members having an inner and outer surface forming, respectively, a portion of the interior wall and a portion of the exterior wall of the container, said container capable of being struck down whereby each vertical side member, vertical end member and top member may be stacked flat on top of the base member within and not extending outside the dimensions of the short and long sides of the base member, characterized by the provision of a coupling means for joining each of said pairs of vertical side members on each side of the container in said co-planar arrangement and in a weatherproof manner about the co-operating edges thereof, the long sides of each of said top and base members being provided with support members fastened thereto, said support members each providing vertically co-extending parallel first and second flanges set respectively adjacent the edges of the respective top or base member, said support members thereby providing a vertical slot between said flanges along each of the long sides of said top and base members so as to receive therein a sealing strip and to receive and support therein the respective vertical side members, there being a plurality of latch means for providing releasable engagement between the support members and the co-operating vertical side members, said latch means, when engaged, exerting a joining force between said respective top or base member and the respective vertical side member, at least one corresponding short side of each of the top and base members being provided with support members fastened thereto, said support members each comprising an angle support strip having a horizontal flange which is fastened to the interior wall surface of the respective top or bottom member and a vertical flange positioned so as to have an outer face which is co-planar with the edge face of the respective top or bottom member on which the angle strip is mounted, the adjacent edges of the adjacent vertical side members being provided with similar angle strips fastened on their interior wall surface so as to have the outer face of a vertical flange co-planar with the edge face of the respective vertical side member on which said angle strip is mounted, and the co-operating end member being bounded on all four sides by angle support strips each having a first flange fastened to the exterior wall surface of said end member and a second flange perpendicular thereto having an interior surface which is adjacent to the respective edge faces of said end member and adjacent to the respective exterior wall surface of the top member, bottom member or vertical side members, there being sealing strips placed adjacent the edges of the last said end member so as to be between its interior wall surface and the edge face of the co-operating top member, bottom member and vertical side members and also the outer face of the flanges of the angle support strips mounted thereon, said end panel being provided along all its four sides with clamping means which are accessible for adjustment outside the container and which have adjustable abutment members which may be moved from non-interfering positions to permit removal of the end panel from the container to positions in which they engage with the angle support strips of said respective top member, bottom member and vertical side members by engagement with the inwardly facing surfaces of said flanges having vertical outwardly facing surfaces which are co-planar with the edge face of the respective top member, bottom member or vertical side member on which said angle support strips are respectively mounted, said adjustable abutment members, when engaged, providing a joining force between the end member and said flanges with which they engage.

2. The container as claimed in claim 1 wherein said coupling means for joining each of said pairs of vertical side members comprises a member having an H-shaped cross-section and having two pairs of laterally spaced arms extending in opposite linear directions from a central portion, said coupling means being positioned between the co-operating edges of said pair of vertical side members in the erected position, there being provided a pair of sealing strips each strip positioned between said central portion and the adjacent co-operating edge of one vertical side member of the pair of vertical side members constituting one side member, there being further provided a latch means for providing releasable engagement of the two panels with said member having an H-shaped cross-section and with each other, said latch means having a co-operative member on each vertical side member of said pair of vertical side members between which engagement takes place, said latch means, when engaged, providing a joining force between the co-operating edges of said respective pairs of vertical side members.

3. The container as claimed in claim 2 wherein said latch means comprise arm means mounted on an eccentric which can be turned to cause the arm means to move into engagement with a pin, said eccentric and said pin each being mounted in a respective bracket means which together constitute said co-operative members.

4. The container as claimed in claim 3 wherein said clamping means comprises a bracket having a central operating pin, said bracket being mounted on said one end member, and an arm constituting said abutment member spring-mounted on a threaded portion of said central operating pin, the arrangement being such that rotation of said central operating pin causes the arm to first rotate simultaneously therewith from a non-abutting to a flange abutting position and then move down said threaded portion to abut said flange of said angle support strip mounted on their respective adjacent members to clamp said end member onto the adjacent edges of the base and top members and vertical side members.

5. The container as claimed in claim 4 wherein said one end panel comprises a door to the container.

6. A container as claimed in claim 5 wherein the base member is provided with three plates on the bottom, each plate having three downwardly projecting skid portions.

7. The container as claimed in claim 1 wherein said clamping means comprises a bracket having a central operating pin, said bracket being mounted on said one end member, and an arm constituting said abutment member spring-mounted on a threaded portion of said central operating pin, the arrangement being such that rotation of said central operating pin causes the arm to first rotate simultaneously therewith from a non-abutting to a flange abutting position and then move down said threaded portion to abut said flange of said angle support strip mounted on their respective adjacent members to clamp said end member onto the adjacent edges of the base and top members and vertical side members.

8. The container as claimed in claim 1 wherein said latch means comprise arm means mounted on an eccentric which can be turned to cause said arm means to move into engagement with a pin, said eccentric and said pin each being mounted on a respective bracket means, said pin and bracket means being mounted on their respective support member, and said eccentric and bracket means being mounted on their respective vertical side member.

9. The container as claimed in claim 1 wherein said coupling means for joining each of said pairs of vertical side members comprises a member having an H-shaped cross-section and having two pairs of laterally spaced arms extending in opposite linear directions from a central portion, said coupling means being positioned between the co-operating edges of said pair of vertical side members in the erected position, there being provided a pair of sealing strips each strip positioned between said central portion and the adjacent co-operating edge of one vertical side member of the pair of vertical side members constituting one side member, there being further provided a latch means for providing releasable engagement of the two panels with said member having an H-shaped cross-section and with each other, said latch means having a co-operative member on each vertical side member of said pair of vertical side members between which engagement takes place, said latch means, when engaged, providing a joining force between the co-operating edges of said respective pairs of vertical side members.

10. The container as claimed in claim 1 wherein said one end panel forms a door to the container.

11. The container as claimed in claim 10 wherein said clamping means comprises a bracket having a central operating pin, said bracket being mounted on said one end member, and an arm constituting said abutment member spring-mounted on a threaded portion of said central operating pin, the arrangement being such that rotation of said central operating pin causes the arm to first rotate simultaneously therewith from a non-abutting to a flange abutting position and then move down said threaded portion to abut said flange of said angle support strip mounted on their respective adjacent members to clamp said door onto the adjacent edges of the base and top members and vertical side members.

* * * * *

UNITED STATES PATENT OFFICE

CERTIFICATE OF CORRECTION

PATENT NO. : 4,625,880

DATED : December 2, 1986

INVENTOR(S) : Kenneth B. Pym

It is certified that error appears in the above-identified patent and that said Letters Patent are hereby corrected as shown below:

Please insert on title page the following:

--[73] Assignee: Premier Containers Limited, Lancashire, England--.

Signed and Sealed this

Seventh Day of April, 1987

*Attest:*

*Attesting Officer*

DONALD J. QUIGG

*Commissioner of Patents and Trademarks*